US008143467B2

(12) United States Patent
Patil et al.

(10) Patent No.: US 8,143,467 B2
(45) Date of Patent: Mar. 27, 2012

(54) PROCESS FOR SYNTHETIC LUBRICANT PRODUCTION

(75) Inventors: Abhimanyu Onkar Patil, Westfield, NJ (US); Satish Bodige, Wayne, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 563 days.

(21) Appl. No.: 12/315,273

(22) Filed: Dec. 2, 2008

(65) Prior Publication Data

US 2009/0156874 A1 Jun. 18, 2009

Related U.S. Application Data

(60) Provisional application No. 61/008,095, filed on Dec. 18, 2007.

(51) Int. Cl.
*C07C 2/02* (2006.01)

(52) U.S. Cl. ..... 585/517; 585/502; 585/520; 585/521; 585/526; 585/527

(58) Field of Classification Search ..... 585/500, 585/502, 517, 520, 521, 522, 523, 527, 526
See application file for complete search history.

(56) References Cited

U.S. PATENT DOCUMENTS

| | | | | |
|---|---|---|---|---|
| 5,017,299 | A | 5/1991 | Gutierrez et al. | |
| 5,186,851 | A | 2/1993 | Gutierrez et al. | |
| 6,395,948 | B1 * | 5/2002 | Hope et al. | 585/510 |
| 6,548,723 | B2 * | 4/2003 | Bagheri et al. | 585/517 |
| 6,548,724 | B2 | 4/2003 | Bagheri et al. | |
| 7,256,152 | B2 | 8/2007 | Olivier-Bourbigou et al. | |
| 7,259,284 | B2 | 8/2007 | Hope et al. | |
| 2002/0128532 | A1 | 9/2002 | Hope et al. | |
| 2002/0183574 | A1 | 12/2002 | Dixon et al. | |
| 2003/0060359 | A1 * | 3/2003 | Olivier-Bourbigou et al. | 502/150 |
| 2004/0030075 | A1 | 2/2004 | Hope et al. | |
| 2005/0113621 | A1 | 5/2005 | Hope et al. | |
| 2006/0149107 | A1 | 7/2006 | Harris et al. | |
| 2006/0247482 | A1 * | 11/2006 | Hope et al. | 585/521 |
| 2006/0264642 | A1 | 11/2006 | Wasserscheid et al. | |
| 2007/0142685 | A1 * | 6/2007 | Elomari et al. | 585/332 |

FOREIGN PATENT DOCUMENTS

| | | |
|---|---|---|
| EP | 0791643 | 8/1997 |
| WO | WO 95/21871 | 8/1995 |
| WO | WO 00/32572 | 6/2000 |
| WO | WO 2007/011459 | 1/2007 |
| WO | WO 2007/011462 | 1/2007 |
| WO | WO 2007/011832 | 1/2007 |
| WO | WO 2007/011973 | 1/2007 |

OTHER PUBLICATIONS

Xiao, L.; et al., Alkane Cracking, Alkene Polymerization, and Friedel-Crafts Alkylation in Liquids Containing the Acidic Anions $HX_2^-$, $XH(AlX_4)^-$, $XH(Al_2X_7)^-$, and $Al_2X_7^-$ (X=chlorine, bromine), Journal of Molecular Catalysis A: Chemical 214/1 121-127 (May 18, 2004).

Stenzel, O., et al., "Oligomerization of Olefins in a Chloroaluminate Ionic Liquid", Journal of Molecular Catalysis A: Chemical 192/1-2 217-222 (Feb. 3, 2003).

* cited by examiner

*Primary Examiner* — In Suk Bullock
*Assistant Examiner* — Bradley Etherton
(74) *Attorney, Agent, or Firm* — Robert A. Migliorini

(57) ABSTRACT

A process for the preparation of oligomeric poly alpha-olefins comprises oligomerizing low molecular weight PAO in the presence of an ionic liquid catalyst under oligomerization conditions. The low molecular weight PAOs used as a feed or feed component of the present process are the light olefinic by-product fraction including the dimers and light fractions from the metallocene-catalyzed PAO oligomerization process.

26 Claims, No Drawings

PROCESS FOR SYNTHETIC LUBRICANT PRODUCTION

CROSS-REFERENCE TO RELATED APPLICATIONS

This is a Non-Provisional Application that claims priority to U.S. Provisional Application 61/008,095 filed Dec. 18, 2007, which is herein incorporated by reference.

FIELD

The present disclosure relates to an improved process for the production of poly-alpha-olefins (PAOs) useful as synthetic lubricant basestocks.

BACKGROUND

The PAOs have been recognized for over 30 years as a class of materials which are exceptionally useful as high performance synthetic lubricant base stocks. They possess good flow properties at low temperatures, relatively high thermal and oxidative stability, low evaporation losses at high temperatures, high viscosity index, good friction behavior, good hydrolytic stability, and good erosion resistance. PAOs are not toxic and are miscible with mineral oils, other synthetic hydrocarbon liquids, fluids and esters. Consequently, PAOs are suitable for use in engine oils, compressor oils, hydraulic oils, gear oils, greases and functional fluids.

PAOs may be produced by the use of Friedel-Craft catalysts such as aluminum trichloride or boron trifluoride with boron trifluoride being the catalyst of choice. Boron trifluoride is advantageously combined with a protic promoter, typically an alcohol such as isopropanol or butanol, water, or an acid, ester or an ether, to form a catalyst complex which may be used to promote oligomerization into products with the desired molecular weight highly branched oligomeric structure required for a combination of low pour point and high viscosity index in the lubricant products. The alpha olefins which are generally used are those in the $C_8$ to $C_{14}$ range, advantageously 1-octene, 1-decene and 1-dodecene; the use of odd carbon number olefins has been found to be unfavorable. Olefins of this type may typically be formed by cracking or by the ethylene chain growth process. The boron trifluoride catalyst normally used in the oligomerization represents a significant cost in process schemes for producing polyalphaolefins since it is generally not recovered but, instead, inactivated by a water wash. The used, inactivated catalyst is often disposed of by deep-well injection in commercial operations producing polyalphaolefins, a disposal method which has some environmental considerations although various methods for recovering the boron trifluoride have been proposed.

In current low viscosity PAO process using the Friedel-Craft catalysts, the dimer or light fractions are recycled into the linear alpha-olefin feed to produce more lube base stock. These dimer or light fractions comprising mostly $C_8H_{16}$ to $C_{30}H_{60}$ oligomers (average $C_{20}H_{40}$), exhibit a relatively low average molecular weight of 280 or less, and are not very desirable as feed stock for the process because the isomerization which accompanies the oligomerization process, although valuable in terms of producing branched-chain higher oligomers which are excellent lubricants with high viscosity index and low pour point, also results in the dimer or light fraction composed of the lower oligomers which are themselves highly branched, highly substituted products with an unsaturated double bond in the middle of the molecule; they may be generally characterized as oligomers in the stated molecular weight range with significant short chain branching and highly substituted double bonds (tri- and tetra-substituted olefins). Being sterically hindered, the double bonds in these light co-products are less accessible and therefore less amenable to further reaction. Thus, these dimer or light fractions are less reactive toward further oligomerization. Furthermore, they are more highly branched olefins and the lube products from these branched molecules have less desirable VI, volatility and thermal/oxidative stability as a consequence of their structure.

The demand for high quality PAO, especially low viscosity/high VI/low pour point PAO is increasing fast and alternatives to the current Friedel-Craft process are being proposed. Supported, reduced chromium catalysts and metallocene catalyst systems have been proposed for such processes. A process using a metallocene catalyst for the production of 4 to 10 cS, low viscosity PAO base stocks is described in WO 2007/011973 (Wu et al). This technology is attractive because the metallocene-based low viscosity PAO has excellent lube properties. One disadvantage of this process so far, has been that when producing 4-10 cS PAO, some amount of dimer or light oligomers, smaller than $C_{30}$ are obtained as co-products. These light olefins cannot be used as lubricant base stocks as they are too volatile and they cannot be recycled into the metallocene-catalyzed process because they are usually more linear and with high degree of vinylidene or vinyl contents. The light fractions from the metallocene oligomerization process therefore represent a lube yield loss if they cannot be converted into lube products by other methods.

Another alternative to the Friedel-Craft catalyzed process is the process using an ionic liquid catalyst. Ionic liquids are liquids that contain essentially only ions rather than molecular species; the term is commonly used for salts whose melting point is relatively low (typically below 100° C.). Processes of this type may be used for producing high viscosity PAOs as described, for example, in U.S. Pat. Nos. 7,259,284; 6,395,948 and U.S. Patent Applications Nos. 2006/0247482; 2005/0113621; 2004/0030075 and 2002/0128532 and EP 0 791 643. An alpha-olefin oligomerization process using a non-nickel transition metal catalyst and an ionic liquid medium is described in U.S. Patent Application No. 2002/0183574 and in this case, the product is reported to be a trimer. A two-step process in which an initial oligomerization is carried out using a metallocene catalyst preceding an oligomerization of the lower molecular weight product using a Friedel-Craft catalyst is described in U.S. Pat. No. 6,548,724.

SUMMARY

We have now developed a scheme to convert the non-lube boiling range light olefinic fractions from the metallocene oligomerization process into high quality lube base stocks, thus significantly increasing the total lube yields from the metallocene-catalyzed, low viscosity PAO oligomerization process and improving the economics of the process. The linear character of these light olefin by-products makes them a good choice for use as a feed for an oligomerization process using a different type of catalyst. They can be oligomerized or co-oligomerized more readily than the branched olefins and produce lube base stocks with less chain branching and consequently better lube properties. We have found that ionic liquids of acidic character may be used as oligomerization catalysts with the metallocene-derived light olefin feeds.

According to the present disclosure, therefore, a process for the preparation of oligomeric poly alpha-olefins comprises oligomerizing low molecular weight PAO in the presence of an acidic ionic liquid catalyst under oligomerization conditions. The low molecular weight PAOs used as a feed or feed component of the present process are the light olefinic by-product fraction including the dimers and light fractions from the metallocene-catalyzed PAO oligomerization process.

The catalyst used in the present oligomerization process comprises an acidic ionic liquid. In general the amount of the ionic liquid used as catalyst is typically between 0.1 to 50 wt % and advantageously between 0.2 to 5 wt % based on total amount of olefin feed.

There are several advantages to using these low molecular weight PAO oligomers for oligomerization or co-oligomerization: (1) flexibility and economy in utilizing a new, previously wasted feedstock, which can be comprised of specific carbon number fractions, a mixture of selected fractions or, most desirably, use of the total, unfractionated PAO distillate byproduct, with or without removal of α-olefins; (2) the greater reactivity afforded by the presence of the terminal vinylidene double bond results in a liquid product with highly desirable properties and high performance features.

DETAILED DESCRIPTION

Olefin Feed:

The olefin feed used in the present process contains a light olefinic by-product fraction including the dimers and light fractions from the metallocene-catalyzed PAO oligomerization process. These light fractions may be generally characterized as the $C_{42}$- (usually $C_{40}$-) PAO distillate fraction comprising a mixture of highly reactive PAO oligomers, the fractions contain mostly $C_8H_{16}$ to $C_{30}H_{60}$ oligomers (average $C_{20}H_{40}$) which exhibit a molecular weight in the range of 120 to 600, typically from 140 to 560 (an average of 200) and contain a terminal olefin content of at least 25% of total olefinic unsaturation. The vinylidene content of the mixture may, in fact, be at least 50%, for example, 60 or even 80%, depending on the metallocene catalyst and the oligomerization conditions. The high amount of vinylidene olefin with correspondingly less of other types of olefinic unsaturation in the PAO dimer fraction is unique, as confirmed by 1H and 13C-NMR and lends a distinction to the present process which utilizes these unique olefins as the starting material for a subsequent oligomerization to produce lube range product with advantageous properties.

The metallocene-derived feed is produced by the oligomerization of an alpha-olefin feed using a metallocene oligomerization catalyst. The alpha-olefin feeds used in this initial oligomerization step are typically alpha-olefin monomers of 4 to 24 carbon atoms, usually 6 to 20 and advantageously 8 to 14 carbon atoms, such as 1-butene, 1-hexene, 1-octene, 1-decene, 1-dodecene, and 1-tetradecene. The olefins with even carbon numbers are preferred as are the linear alpha-olefins although it is possible to use branched-chain olefins containing an alkyl substituent at least two carbons away from the terminal double bond. These 1-olefins may be co-oligomerized with other monomers in the same molecular weight range. These starting materials are oligomerized using a metallocene catalyst to produce a range of products extending from the low molecular weight dimers and trimers which form the majority of the feed for the present ionic liquid catalyzed step as well as higher molecular weight oligomers in the lube boiling range which are directly useful as lube base stocks. The initial feed olefins are advantageously treated to remove catalyst poisons, such as peroxides, oxygen, sulfur, nitrogen-containing organic compounds, and or acetylenic compound as described in WO 2007/011973, incorporated herein by reference. This treatment is believed to increase catalyst productivity, typically more than 5 fold, and in favorable cases, more than 10 fold. The lowest molecular weight oligomers from these alpha-olefin starting materials typically have carbon numbers ranging from $C_8$ to $C_{30}$, in most cases from $C_{16}$ to $C_{30}$. These small oligomers are usually separated by fractionation from the higher oligomers with carbon number of greater than $C_{30}$, for example $C_{40}$ and higher which are typically used as the high performance lube base stocks.

The initial oligomerization step using the metallocene catalyst is carried out under the conditions appropriate to the selected alpha-olefin feed and metallocene catalyst. An advantageous metallocene-catalyzed alpha-olefin oligomerization process is described in WO 2007/011973 to which reference is made for details of feeds, metallocene catalysts, process conditions and characterizations of products. The light olefinic oligomers produced from that process and which are used as feed in the present PAO oligomerization process may suitably be separated from the raw mixture of PAOs obtained from the metallocene oligomerization step by distillation with the cut point set at a value dependent upon the fraction to be used as lube base stock or the fraction to be used as feed in the present process. As noted in WO 2007/011973, the PAOs selected for the lube base stock fraction are liquids which have no melting point above 0° C., a pour point less than 0° C., typically less than −45° C. or even lower, e.g. less than −75° C. advantageously with a $KV_{100}$ of 1.5-20 cSt, which in most cases will be selected depending on desired product specifications as in the range from 1.5 to 10 cSt. The volatility of the lube range fraction as measured by the Noack Volatility test (ASTM D5800) is typically of 25 wt % or less, advantageously 14 wt % or less. The Bromine number of the lube fraction is typically of 1.8 or more, to be reduced by hydrogenation prior to use as a lube base stock. In terms of molecular weight range, the fraction selected for use as lube base stock typically has a selectivity of 80% or more for $C_{20}$ and greater hydrocarbons, advantageously 85% or more, advantageously 90% or more, more advantageously 95% or more, advantageously 98% or more, advantageously 99% or more for $C_{20}$ and greater hydrocarbons. The corresponding selectivities for $C_{20}$ and lower hydrocarbons are normally 50% or less, advantageously 40% or less, e.g. 20% or less, 10% or less.

The metallocene catalysts used in the process of WO 2007/011973 are unbridged, substituted bis-cyclopentadienyl transition metal compounds. One advantageous class of catalysts are the highly substituted metallocenes that give high catalyst productivity and with low product viscosity. Another advantageous class of metallocene catalysts is unbridged and substituted cyclopentadienes, including unbridged and substituted or unsubstituted indenes and or flourenes. Optionally an activator for the metallocene component may be used at a molar ratio of transition metal compound to activator typically from 10:1 to 0.1:1, e.g. a methyluminoxane (MAO); if an organoaluminum compound, e.g. an alkyl aluminum compound, is used as the activator, the molar ratio of alkyl aluminum compound to transition metal compound may be in the range of 1:4 to 4000:1. Oligomerization conditions typically call for hydrogen to be present at a partial pressure of 345 kPa (50 psi) or less, based upon the total pressure of the reactor, typically between 7 kPa (1 psi) and 345 kPa (50 psi), (advantageously between 20 kPa (3 psi) and 275 kPa (40 psi), e.g. between 35 kPa (5 psi) and 210 kPa psi (30), or 175 kPa (25 psi) or less, advantageously 70 kPa (10 psi) or less. Hydrogen is normally present at a concentration of 10 to 10,000 ppm by weight, advantageously 25 to 7,500 ppm, e.g. 25 to 5,000 ppm with the alpha-olefin monomer(s) feed at 10 volume percent or more based upon the total volume of the catalyst/activator/co-activator solutions, monomers, and any diluents or solvents present in the reaction. Residence time of the reaction is typically at least 5 minutes, and the temperature in the reaction zone is controlled not to by more than 10° C. during the reaction. The metallocene catalyst components, activators and typical and advantageous reaction conditions and product parameters are all described in WO 2007/011973, to which reference is made for such description.

An alternative metallocene-catalyzed alpha-olefin oligomerization process which may yield dimer fractions useful as feed for the second oligomerization step of the present is described in U.S. Pat. No. 6,548,724, incorporated herein by reference, and additional metallocene-catalyzed oligomerization processes in the references cited in this patent, to which reference is made for details of such alternative processes. Other metallocene polymerization processes which may yield dimer fractions useful as feed for the second oligomerization step of the present invention are described in WO2007011459, WO2007011462, and in U.S. Pat. Nos. 5,017,299 and 5,186,851, all of which are herein incorporated by reference, to which reference is also made for information concerning such metallocene-catalyzed oligomerization processes. Light olefin PAO fractions from such metallocene oligomerization processes using alpha-olefin starting materials may be used as the feeds in the present process which utilizes such light olefinic by-products as a component of the feed.

The dimers used as feed for the present process possess at least one carbon-carbon unsaturated double bond. The unsaturation is normally more or less centrally located at the junction of the two monomer units making up the dimer as a result of the non-isomerizing polymerization mechanism characteristic of metallocene processes. If the initial metallocene polymerization step uses a single 1-olefin feed to make a PAO homopolymer the unsaturation will be centrally located, but if two 1-olefin comonomers have been used to form a metallocene copolymer the location of the double bond may be shifted off center in accordance with the chain lengths of the two comonomers used. In any event, this double bond is vinylic or vinylidenic in character. The terminal vinylidene group is represented by the formula $RaRbC{=}CH_2$, referred to as vinyl when Rb=H. The amount of unsaturation can be quantitatively measured by bromine number measurement according to ASTM D1159 or equivalent method, or according to proton or carbon-13 NMR. Proton NMR spectroscopic analysis can also differentiate and quantify the types of olefinic unsaturation.

The characteristic vinylidene compounds which make up at least 25% of the olefin feed for the present oligomerization process may therefore be defined as unsaturated hydrocarbons of the formula:

$$R1R2C{=}CH_2$$

where R1 and R2, which may be the same or different, together have from 6 to 40 carbon atoms and R1 is a hydrocarbon group of 1 to 24 carbon atoms, R2 is R1 or H. Typically, R1 and R2 together have from 16 to 30 carbon atoms, advantageously 8 to 11 carbon atoms and in the case of dimers prepared from single monomers, R1 and R2 are the same. In the advantageous dimers, R1 and R2 each have from 7 to 13 carbon atoms.

The light olefin fraction from the metallocene oligomerization process may be used as the sole feed material in the present process or it may be used as one of the olefinic feed components together with an alpha-olefin of the type used as the olefin starting material for the metallocene oligomerization step. Thus, for example the metallocene light olefinic PAO may be used as feed combined with a monomeric alpha-olefin of 6 to 24 carbon atoms, usually 6 to 20 and advantageously 8 to 14 carbon atoms, advantageously olefins with an carbon numbered olefin (such as 1-decene, 1-octene, 1-dodecene, 1-hexene, 1-tetradecene, 1-octadecene or mixtures thereof) if optimal lube properties are to be achieved. The linear alpha-olefins are advantageous but it is possible also to use branched-chain olefins containing an alkyl substituent at least two carbons away from the terminal double bond. The proportion in which the light olefinic PAO may be used is likely to be set in practical operation by the availability of starting materials and the parameters which are desired for the products which themselves are also dependent on the reaction conditions used in the ionic-liquid catalyzed oligomerization step of the present process. Typical ratios are from 90:10 to 10:90 and more usually 80:20 to 20:80 by weight but normally the light PAO fraction will make up at least 50% by weight of the olefinic feed material since the properties of the final PAO product, dependent in part upon the starting material, are favorably affected by increasing proportions of the light PAO fraction. Advantageous proportions for the light PAO fraction in the olefin feed are therefore at least 50% and more advantageously at least 60%, or at least 70%, or at least 80% by weight.

Ionic Liquid Catalyzed Oligomerization:

The oligomerization reaction of the present disclosure is carried out in the presence of a catalyst comprising an acidic ionic liquid. As noted above, most of the ionic liquids are salts (100% ions) with a melting point below 100° C.; they typically exhibit no measurable vapor pressure below thermal decomposition. The properties of ionic liquids result from the composite properties of the wide variety of cations and anions which may be present in these liquids. Many of the ionic liquids are liquid over a wide temperature range (often more than 300° C.). They have low melting points (as low as −96° C. has been reported), which can be attributed to large asymmetric cations having low lattice energies. As a class of materials, ionic liquids are highly solvating for both organic and inorganic materials. Depending on the ions present, ionic liquids may be neutral, basic or acidic in character. The acidic liquids will function themselves as catalysts for oligomerization and thus may be used directly. The neutral ionic liquids will function catalytically in the present process if an additional Lewis acid component is present to confer the necessary acidity.

Many of them are nonflammable, non-explosive and have high thermal stability. They are also recyclable, which can be helpful in reducing environmental concerns over their use.

The acidic ionic liquid oligomerization catalyst system will often be comprised of at least two components of which one is the ionic liquid and the other provides the desired acidic property; if, however, the ionic liquid is itself acidic, it may be used on its own as the oligomerization catalyst. In many instances, however, the catalyst system will be a two component system with the first component being an acidic component, i.e a Lewis acid such as an aluminum halide or an alkyl aluminum halide. For example, a typical first Lewis acid component of the catalyst system may be aluminum trichloride. The second, ionic liquid, component is advantageously a quaternary ammonium, quaternary phosphonium, or tertiary sulfonium compound, such as, for example, a liquid salt selected from one or more of hydrocarbyl substituted ammonium halides, hydrocarbyl substituted imidazolium halide, hydrocarbyl substituted pyridinium halide, hydrocarbyl substituted phosphonium halide. For example, 1-ethyl-3-methylimidazolium chloride can be used as a second component.

The ionic liquid is primarily a salt or mixture of salts which melts below room temperature, as noted above. Ionic liquids may be characterized by the general formula $Q^+A^-$, where is $Q^+$ is quaternary ammonium, quaternary phosphonium or quaternary sulfonium, and $A^-$ is a negatively charged ion such as $Cl^-$, $Br^-$, $OCl_4^-$, $NO_3^-$, $BF_4^-$, $BCl_4^-$, $PF_6^-$, $SbF_6^-$, $AlCl_4^-$, $CuCl_2^-$, $FeCl_3^-$.

If a two component catalyst system is used, the mole ratio of the two components of the catalyst system will usually fall within the range of from 1:1 to 5:1 of the first (Lewis acid) component to the second (ionic liquid) component; more advantageously the mole ratio will be in the range of from 1:1 to 2:1.

Structures of typical compounds which may be used as the ionic liquid component of the catalyst system are shown below.

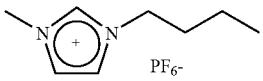

1-Butyl-3-methylimidazolium hexafluorophosphate [$bmim^+$][$PF_6^-$]

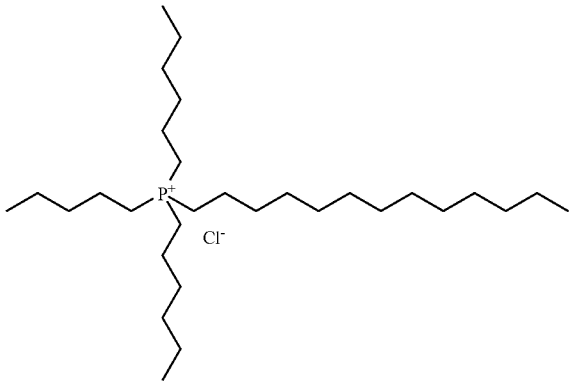

Trihexyl(tetradecyl)phosphonium chloride [$thtdPh^+$][$Cl^-$], commercially available as CYPHOS IL 101™ (Hydrocarbon soluble (hexane, toluene) $T_g$−56° C.)

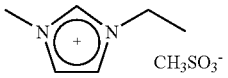

1-Ethyl-3-methylimidazolium methanesulfonate [$emim^+$] [$CH_3SO_3^-$] (Mol. wt 206.27, mp 35° C.)

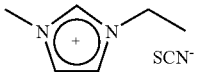

1-Ethyl-3-methylimidazolium thiocyanate [$emim^+$][$SCN^-$] (molecular weight 169.25, mp<−20° C.)

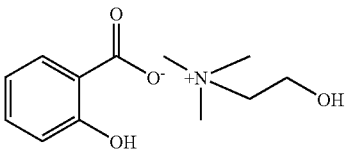

Choline Salicylate, commercially available as BASIONIC FS 65™ (molecular weight 241.28, mp 36° C.).

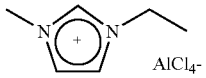

1-Ethyl-3-methylimidazolium tetrachloroaluminate [$emim^+$] [$AlCl_4^-$] (molecular weight 279.96, mp 9° C.)

Other ionic liquids that can be used as the second component include:

1-Butyl-3-methylimidazolium hexafluorophosphate [bmim] [$PF_6^-$]

Hexyl-3-methylimidazolium dioctylsulfosuccinate [hmim] [$doss^-$]

1-Hexyl-3-methylimidazolium hexafluoroborate [hmim] [$BF_4^-$],

1-Hexyl-3-methylimidazolium hexafluorophosphate [hmim] [$PF_6^-$]

Tetrabutyl ammonium dioctylsulfosuccinate [tbam][$doss^-$]

Tetrabutyl phosphonium dioctylsulfosuccinate [tbPh][$doss^-$]

Tributyl(tetradecyl)phosphonium dodecylbenzenesulfonate [tbtdPh][$dbs^-$]

Tributyl(tetradecyl)phosphonium methanesulfonate [tbtdPh] [$mes^-$]

Trihexyl(tetradecyl)phosphonium bis(trifluoromethane)sulfonylimide [thtdph][$Tf_2N^-$]

Trihexyl(tetradecyl)phosphonium chloride [thtdPh][$Cl^-$]

Trihexyl(tetradecyl)phosphonium decanoate [thtdph][$deca^-$]

Trihexyl(tetradecyl)phosphonium dodecylbenzenesulfonate [thtdPh][$dbs^-$]

Trihexyl(tetradecyl)phosphonium methanesulfonate [thtdPh][$mes^-$]

Triethylsulfonium bis(trifluromethylsulfonyl)imide. $C_8H_{15}F_6NO_4S_3$ [321746-49-0].

The catalyst system, being a liquid may also function as the solvent or diluent for the reaction so that no additional solvent or diluent is required; additional liquids which are non-reactive to the selected catalyst system may, however, be present if desired, for example, to control viscosity of the reaction mixture or to carry off heat of reaction by evaporation with reflux of the condensed vapor. Thus, the light PAO reactant, either as such or with additional alpha-olefin co-feed may be oligomerized directly in the presence of the catalyst system without the addition of solvent or diluent. Since many ionic liquids are hydrocarbon soluble as a result of the presence of long chain hydrocarbon substituents, the reaction will normally proceed with a single phase reaction mixture.

The oligomerization reaction temperature can usefully vary in practical operation between −10° C. to 300° C., advantageously between 0° C. to 75° C. The system may operate under atmospheric pressure since, as noted above, the ionic liquids typically exhibit low vapor pressures at the temperatures normally used for this process. It may, however, be operated under mild pressure if it is desired to maintain a closed reaction environment, e.g. under autogenous pressure.

Following completion of the oligomerization reaction, the organic layer containing the PAO product and the unreacted low molecular weight feed is separated from the ionic liquid phase. The acidic ionic liquid catalyst that remains after recovery of the organic phase may be recycled to the oligomerization reaction.

Oligomer Product:

The formation of the oligomer product from the PAO starting material may be represented, taking 1-ethyl-3-methylimidazolium heptachloroaluminate [$emim^+$][$AlCl7^-$] as an exemplary catalyst, and 2-octyl-dodec-1-ene as an exemplary PAO reactant, by the following scheme:

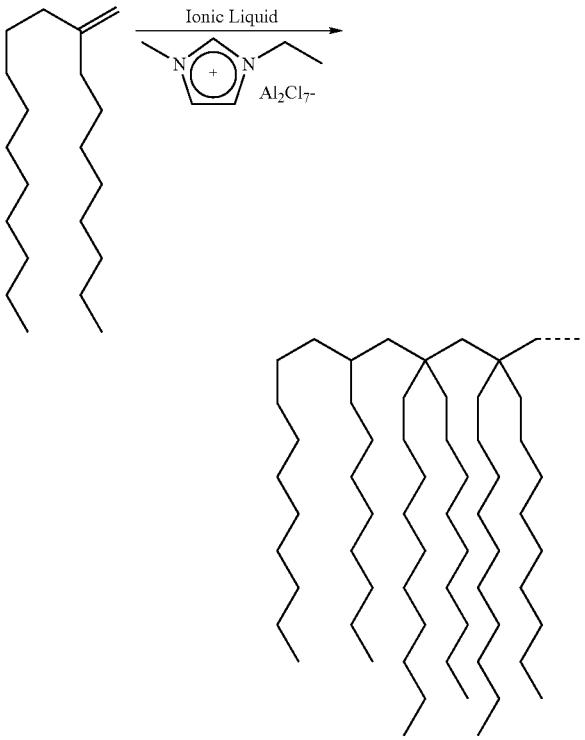

In this case, the portion of the oligomer product shown is a trimer of the PAO reactant with a highly branched chain structure which may be expected to constitute a lube base stock component of low volatility, low pour point and high viscosity index. Depending on the carbon number of the starting material and the reaction conditions selected, however, the product may be a dimer, trimer or a higher oligomer with successive units attached through the double bond sites of the PAO reactant. The degree of chain branching will largely be determined by the PAO reactant so that if the metallocene-produced PAO itself has some degree of chain branching (as by the use of a branched chain olefin as feed to the metallocene oligomerization system) additional branching will be present in the final product from the ionic liquid catalyzed reaction. However, as pointed out above, the metallocene oligomers are largely linear oligomers with a central olefinic double bond at which addition takes place.

In the Examples below, the metallocene dimer fraction may be produced using a synthesis method of the type described in WO2007011973, WO2007011832 or WO 2007011459, each of which are herein incorporated by reference. In the preparative procedures actually used, toluene solvent and feed alpha-olefins were purified according to the methods described in these publications and all synthesis steps and manipulations were carried out under nitrogen atmosphere to avoid any catalyst deactivation or poison by air, oxygen, moisture and other poisons.

Preparation of stock solutions used in mPAO synthesis—Triisobutylaluminum (TIBA) or tri-n-octylaluminum (TNOA) stock solution was prepared by dissolving 4 grams of a 25 wt % TIBA or TNOA in toluene (available from Aldrich Chemical Co.) in 46 gram of purified toluene solvent. All metallocene stock solution was prepared by dissolving 0.05 gram metallocene in 49.95 gram purified toluene solvent. Non-coordinating anion (NCA) activator stock solution was prepared by dissolving 0.05 gram N,N-dimethylanilinium tetra(pentafluorophenyl)borate in 49.95 gram purified toluene solvent.

Metallocene PAO can be synthesized using a batch mode of operation using the following exemplary procedure. The sample can be prepared by charging 50 gram purified 1-decene and 3.173 gram of TIBA stock solution into a 500 ml flask under nitrogen atmosphere. The reaction flask is then heated to 120° C. with stirring. A solution in an additional funnel mounted on the reaction flask containing 20 gram toluene, 0.079 gram TIBA stock solution, 0.430 gram stock solution of rac-ethylenebis(4,5,6,7-tetrahydro-1-indenyl)zirconium dichloride and 0.8012 NCA stock solution was added to the 1-decene mixture within 15 minutes while maintaining reaction temperature close to 120° C., no more than 3° C. higher or lower. The reaction mixture is stirred at reaction temperature for 16 hours. The heat is then turned off and the mixture quenched with 3 ml isopropanol. The crude product is then washed with 100 ml of a 5% aqueous NaOH solution, followed by 100 ml deionized water three times. The organic layer is then separated and dried with 20 gram sodium sulfate for one hour. The solid is filtered off and the filtrate distilled first by low vacuum distillation to remove toluene, unreacted 1-decene and the light olefin dimer fraction, followed by high vacuum distillation at 160° C./1 millitorr vacuum to isolate $C_{30}$ and higher oligomers. The dimer fraction may then be separated from the toluene and unreacted monomer by distillation.

EXAMPLES

Example 1

Co-oligomerization of PAO oligomer using 1-ethyl-3-methyl imidazolium heptachloroaluminate.

The mPAO used in this Example was synthesized in a manner similar to the mPAO of the general procedure described above, except that the reaction was conducted in a 600-ml Parr autoclave. In this run, 90 gram 1-decene and 4.0 gram of TNOAL stock solution was charged into the autoclave and heated to 80° C. The reactor was pressurized with hydrogen to 70 kPa (10 psi). Then, a catalyst solution containing 20 gram toluene and 0.5 gram TNOAL stock solution, 1.60 gram stock solution of bis(1-methyl-3-n-butylcyclopentadienyl)zirconium dimethyl and 3.84 gram of NCA activator was charged into the autoclave. After 16 hours of reaction, the reactor was cooled down, vented and the reaction mixture worked up in a similar manner to the general procedure. The resulting PAO had the following property: 100° C. Kv=10.11 cS, 40° C. Kv=56.67 cS, VI=156 Mn by GPC=1080. Typically, this type of metallocene derived PAO has 4% 1,2-disubstituted olefin, 19% tri-substituted olefin and 77% vinylidene olefin by either H1-NMR or C13-NMR.

A dimer fraction (20.34 g) produced as a low boiling fractional by-product of the metallocene-catalyzed oligomerization process described above was used as the starting material for the ionic liquid catalyzed reaction described below.

This dimer material was charged to a cooled 250 ml round bottom flask under $N_2$ atmosphere. Freshly prepared 1-ethyl-3-methylimidazolium heptachloroaluminate (2.0 g) was added very slowly to maintain the reaction temperature 0-5° C. After addition, the homogeneous reaction mixture was stirred for 4 hours at 0-5° C. The reaction was stopped by adding 25 ml water and 100 ml toluene. The product was washed with water (4×100 ml) and (1×100 ml) brine until the aqueous layer attained pH ~7. The hydrocarbon layer was separated, dried and filtered. The low boiling (toluene) component was then removed from the high boiling component (PAO-Dimer) using a rotary evaporator with an air bath oven at 160-170° C. under vacuum.

The final product was analyzed by IR, GC, NMR and GPC. GPC of the product suggests $M_n$ of 1068, polydispersity of 1.153 and peak mw of 1281. The GC analysis showed 90.34% product conversion, 8.55% PAO-Dimer, 81.9% of lube product. The distilled oligomer was found to display the following properties as shown in Table 1 below. The kinematic viscosity (KV) of the liquid product was measured using ASTM standards D445 and reported at temperatures of 100° C. (KV 100° C.) or 40° C. (KV 40° C.). The viscosity index (VI) was measured according to ASTM standard D2270 using the measured kinematic viscosities for each product.

TABLE 1

| | |
|---|---|
| KV 100° C. | 9.25 CSt |
| KV 40° C. | 59.9 CSt |
| Viscosity Index | 135 |
| Pour point | −54° C. |

Example 2

Co-oligomerization of polyalpholefins with 1-decene using 1-ethyl-3-methyl imidazolium heptachloroaluminate.

The PAO-dimer used in Example 1 (20.34 g) was charged with 10.23 g of 1-decene into a cooled 500 ml round bottom flask under $N_2$ atmosphere. Freshly prepared 1-ethyl-3-methylimidazolium heptachloroaluminate (3.11 g) was added very slowly to maintain the temperature at 0-5° C. After addition, the homogeneous reaction mixture was stirred for 4 hours at 0-5° C. The reaction was stopped by adding 50 ml water and 100 ml toluene. The product was washed with water (4×100 ml) and (1×100 ml) brine until the aqueous layer attained pH ~7. The hydrocarbon layer was separated, dried and filtered. The low boiling (toluene) component was then removed from the high boiling component (PAO-Dimer) using a rotary evaporator with an air bath oven at 160-170° C. under vacuum.

The final product was analyzed by IR, GC, NMR and GPC. GPC of the product suggests $M_n$ of 1216, polydispersity of 1.234 and peak Mw of 1341. The GC analysis showed 96.7% product conversion, 2.77% PAO-Dimer, 87.46% of lube product. The distilled oligomer was found to display the properties shown in Table 2 below.

TABLE 2

| | |
|---|---|
| KV 100° C. | 12.76 CSt |
| KV 40° C. | 92.63 CSt |
| Viscosity Index | 136 |
| Pour point | −54° C. |

Applicants have attempted to disclose all embodiments and applications of the disclosed subject matter that could be reasonably foreseen. However, there may be unforeseeable, insubstantial modifications that remain as equivalents. While the present disclosure has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. All numerical values within the detailed description and the claims herein are modified by "about" or "approximately" the indicated value, and take into account experimental error and variations that would be expected by a person having ordinary skill in the art.

What is claimed is:

1. A process for the preparation of low viscosity oligomeric poly alpha-olefins which comprises oligomerizing in the presence of an acidic ionic liquid oligomerization catalyst a low molecular weight PAO feed produced by the metallocene-catalyzed oligomerization of an alpha-olefin feed, wherein the concentration of a light PAO fraction in the PAO feed is at least 50 wt. % and wherein the vinylidene content in the PAO feed is at least 50 wt. %, wherein the kinematic viscosity of the poly alpha-olefins at 100 deg. C. is less than or equal to 12.76 cSt, and wherein the low molecular weight PAO feed has a molecular weight in the range of 120 to 600.

2. A process according to claim 1 in which the low molecular weight PAO feed comprises a mixture of $C_8H_{16}$ to $C_{30}H_{60}$ oligomers of the alpha-olefin feed.

3. A process according to claim 2 in which the low molecular weight PAO feed comprises a mixture of $C_8H_{16}$ to $C_{30}H_{60}$ oligomers of the alpha-olefin feed having a molecular weight in the range of 120 to 600, and containing a terminal olefin content of at least 60 wt. % of total olefinic unsaturation.

4. A process according to claim 3 in which the terminal olefin content of the low molecular weight PAO feed is at least 80 wt. % of total olefinic unsaturation.

5. A process according to claim 1 in which the alpha-olefin feed comprises a $C_8$ to $C_{14}$ feed.

6. A process according to claim 1 in which the ionic liquid oligomerization catalyst comprises a Lewis acid component and an ionic liquid component.

7. A process according to claim 6 in which the Lewis acid component comprises an aluminum halide or alkyl aluminum halide.

8. A process according to claim 7 in which the aluminum halide comprises aluminum trichloride.

9. A process according to claim 1 in which the ionic liquid oligomerization catalyst comprises a quaternary ammonium, quaternary phosphonium, or tertiary sulfonium compound.

10. A process according to claim 1 in which the ionic liquid oligomerization catalyst comprises a liquid salt selected from one or more of hydrocarbyl substituted ammonium halides, hydrocarbyl substituted imidazolium halides, hydrocarbyl substituted pyridinium halides and hydrocarbyl substituted phosphonium halides.

11. A process according to claim 6 in which the molar ratio of the Lewis acid component to the ionic liquid component is from 1:1 to 5:1 (Lewis acid component:ionic liquid).

12. A process according to claim 11 in which the molar ratio of Lewis acid component to the ionic liquid component is from 1:1 to 2:1 (Lewis acid component:ionic liquid).

13. A process according to claim 1 in which the amount of the ionic liquid catalyst is between 0.1 to 50 wt % based on total amount of low molecular weight PAO feed.

14. A process according to claim 1 in which the low molecular weight PAO is co-oligomerized with an alpha-olefin comonomer in the presence of the ionic liquid oligomerization catalyst.

15. A process according to claim 14 in which the alpha-olefin comonomer comprises a $C_8$ to $C_{14}$ alpha-olefin.

16. A process according to claim 1 in which the oligomerization in the presence of the ionic liquid catalyst is carried out at a temperature from 0 to 75° C.

17. A process for the preparation of low viscosity oligomeric poly alpha-olefins which comprises co-oligomerizing in the presence of an acidic ionic liquid oligomerization catalyst system, (i) a $C_{40}$-olefinic fraction derived from a low molecular weight PAO feed produced by the metallocene-catalyzed oligomerization of a $C_8$ to $C_{14}$ alpha-olefin feed and comprising a mixture having a molecular weight in the range of 120 to 600, of $C_8H_{16}$ to $C_{30}H_{60}$ oligomers of the alpha-olefin feed, and containing a terminal olefin content of at least 50% of total olefinic unsaturation, (ii) a $C_8$ to $C_{14}$ alpha-olefin, wherein the concentration of a light PAO fraction in the PAO feed is at least 50 wt. % and wherein the kinematic viscosity of the oligomeric poly alpha-olefins at 100 deg. C. is less than or equal to 12.76 cSt.

18. A process according to claim 17 in which the ionic liquid oligomerization catalyst system comprises a liquid salt selected from one or more of hydrocarbyl substituted ammonium halides, hydrocarbyl substituted imidazolium halides, hydrocarbyl substituted pyridinium halides and hydrocarbyl substituted phosphonium halides.

19. A process according to claim 18 in which the acidic ionic catalyst system comprises a Lewis acid component and an ionic liquid in the molar ratio of from 1:1 to 2:1 (Lewis acid component:ionic liquid).

20. A process according to claim 17 in which the amount of the ionic liquid catalyst is between 0.1 to 50 wt % based on total amount of low molecular weight PAO feed and $C_8$ to $C_{14}$ alpha-olefin comonomer.

21. A process for the preparation of low viscosity oligomeric poly alpha-olefins in the lube oil boiling range which comprises oligomerizing, in the presence of an acidic ionic liquid oligomerization catalyst, a low molecular weight olefinic feed which comprises at least 50 wt. % of vinylidene compounds of the formula:

$$R1R2C{=}CH_2$$

where R1 and R2, which may be the same or different, together have from 6 to 40 carbon atoms and R1 is a hydrocarbon group of 1 to 24 carbon atoms, wherein the concentration of a light PAO fraction in the olefinic feed is at least 50 wt. % wherein the kinematic viscosity of the oligomeric poly alpha-olefins at 100 deg. C. is less than or equal to 12.76 cSt, and wherein the low molecular weight olefinic feed has a molecular weight in the range of 120 to 600.

22. A process according to claim 21 in which R1 and R2 together have from 16 to 30 carbon atoms.

23. A process according to claim 22 in which R1 and R2 each have 8 to 11 carbon atoms.

24. A process according to claim 21 in which the low molecular weight olefinic feed comprises at least 60 wt % of the vinylidene compounds of the formula $R1R2C{=}CH_2$.

25. A process according to claim 24 in which the low molecular weight olefinic feed comprises at least 80 wt % of the vinylidene compounds of the formula $R1R2C{=}CH_2$.

26. A process according to claim 17 in which the ionic liquid oligomerization catalyst comprises a quaternary ammonium, quaternary phosphonium, or tertiary sulfonium compound.

* * * * *